United States Patent [19]

Yamamoto et al.

[11] Patent Number: 4,565,462

[45] Date of Patent: Jan. 21, 1986

[54] PAPER LOADING APPARATUS FOR PRINTER INCLUDING PLURAL FEED PATHS

[75] Inventors: Takemi Yamamoto; Susumu Kuzuya; Isao Kagami; Yuuichi Takenaka, all of Nagoya, Japan

[73] Assignee: Brother Kogyo Kabushiki Kaisha, Nagoya, Japan

[21] Appl. No.: 551,883

[22] Filed: Nov. 15, 1983

[30] Foreign Application Priority Data

Nov. 20, 1982 [JP] Japan ..... 57-204246
Nov. 20, 1982 [JP] Japan ..... 57-175692[U]

[51] Int. Cl.[4] ..... B41J 13/10

[52] U.S. Cl. ..... 400/625; 400/629; 400/708; 271/3; 271/902

[58] Field of Search ..... 400/605, 620, 621, 624, 400/625, 629, 708, 144.2; 271/3, 3.1, 116, 265, DIG. 9

[56] References Cited

U.S. PATENT DOCUMENTS

| | | | |
|---|---|---|---|
| 3,652,083 | 3/1972 | Bosshardt | 271/116 |
| 3,716,178 | 2/1973 | Shimmin | 271/3 X |
| 3,755,653 | 8/1973 | Venker | 271/DIG. 9 X |
| 4,073,585 | 2/1978 | Kobayashi et al. | 271/DIG. 9 X |
| 4,084,805 | 4/1978 | Simpson | 400/625 X |
| 4,157,822 | 6/1979 | Miller | 271/3.1 |
| 4,161,312 | 7/1979 | Eckhardt et al. | 271/265 X |
| 4,234,261 | 11/1980 | Hendrischk et al. | 400/621 |
| 4,262,894 | 4/1981 | Marano | 400/625 X |
| 4,268,021 | 5/1981 | Rutishauser et al. | 400/625 X |
| 4,285,607 | 8/1981 | Steinhilber | 400/625 |
| 4,398,837 | 8/1983 | Torii et al. | 400/144.2 X |

OTHER PUBLICATIONS

IBM Technical Disclosure Bulletin, "Cut-Form Handling Device for Use in a Printer", Kanno, vol. 23, No. 6, Nov. 1980, pp. 2334–2335.

*Primary Examiner*—Ernest T. Wright, Jr.
*Attorney, Agent, or Firm*—Browdy and Neimark

[57] ABSTRACT

A paper loading apparatus for a printer wherein sheets of paper are moved by a paper feeding device to a printing device to effect printing on the paper. The apparatus comprises a paper stacker for storing a stack of the sheets of paper, a feed roller engageable with the top of the paper stack and rotatable for feeding along a first paper path the individual sheets in one direction from the paper stacker toward the paper feeding device, a controller for controlling the paper feeding device such that the sheets of paper fed from the paper stacker are first moved in the above one direction into the printing device and subsequently moved in a reverse direction opposite to the above one direction, and a guiding device for guiding the sheet of paper moving in the reverse direction along a second paper path in which the sheet of paper is free from engagement with the feed roller.

5 Claims, 10 Drawing Figures

28b
28

66
32b
32a
29a
29
28a
28
Z
4b
17c
17a
W
13
30
31
21
22
23a
27
23b
4
10
12
9
11
34

23a
33b
66
33a
29a
29
28a
Y
28
X
4a
17c
17a
W
13
31
30
21
22
33a
33b
33
6

38
40
39
37
36
35

PAPER LOADING APPARATUS FOR PRINTER INCLUDING PLURAL FEED PATHS

BACKGROUND OF THE INVENTION

The present invention relates to a paper loading apparatus for loading sheets of paper to a typewriter or other forms of printing instrument to effect printing on the loaded sheet of paper.

In a printer having a paper loading apparatus equipped with a paper storage tray or stacker in which a stack of paper sheets are stored with the top sheet in pressed contact with a feed roller or rollers, the individual paper sheets are fed one after another, by the feed rollers in cooperation with a paper feeding device such as a paper moving platen, until the leading edge of the paper sheet has reached a predetermined position. Upon the paper sheet being fed into position, the feed rollers are stopped to prevent the second sheet from being fed. In printing operations involving a tabulation or graphical representation, there is a need for moving back the paper sheet by the paper feeding device toward the feed rollers. In such instance, the trailing edge of the paper may be caught by the feed rollers and the paper may possibly be bent, warped or creased.

SUMMARY OF THE INVENTION

It is accordingly an object of the present invention to provide a paper loading apparatus having a paper storage stacker and a feed roller, which is free from the above indicated incoveniences experienced upon backward movement of a loaded paper sheet away from a printing device.

According to the present invention, there is provided a paper loading apparatus for a printer wherein sheets of paper are moved by a paper feeding device to a printing device for impression of characters on the paper along a line of printing. The apparatus comprises a paper stacker for storing a stack of the sheets of paper of one kind, a feed roller engageable with the top of the paper stack and rotatable for feeding along a first paper path the invididual sheets of paper one after another in one direction from the paper stacker toward the paper feeding device, control means for controlling the paper feeding device such that the sheet of paper fed from the paper stacker by the feed roller is first moved in said one direction into the printing device and subsequently moved in a reverse direction opposite to said one direction, and guide means for guiding the sheet of paper moving in the reverse direction along a second paper path in which the sheet of paper is free from engagement with the feed roller.

In a paper loading apparatus constructed as described above, a sheet of paper which has been loaded onto the printing device is kept free from bending, warpage or crease thereof due to otherwise possible engagement of its trailing edge with the feed roller upon backward movement of the paper away from the printing device during printing involving a tabulation, graphic representation or the like which requires backward and forward movements of the paper sheet across the line of printing.

BRIEF DESCRIPTION OF THE DRAWING

The above and other objects, features and advantages of the present invention will be seen by reference to the description of the preferred embodiment, taken in connection with the accompanying drawing in which.

DETAILED DESCRIPTION OF THE PREFERRED EMBODIMENT

Figures 1A, 2A, 3:
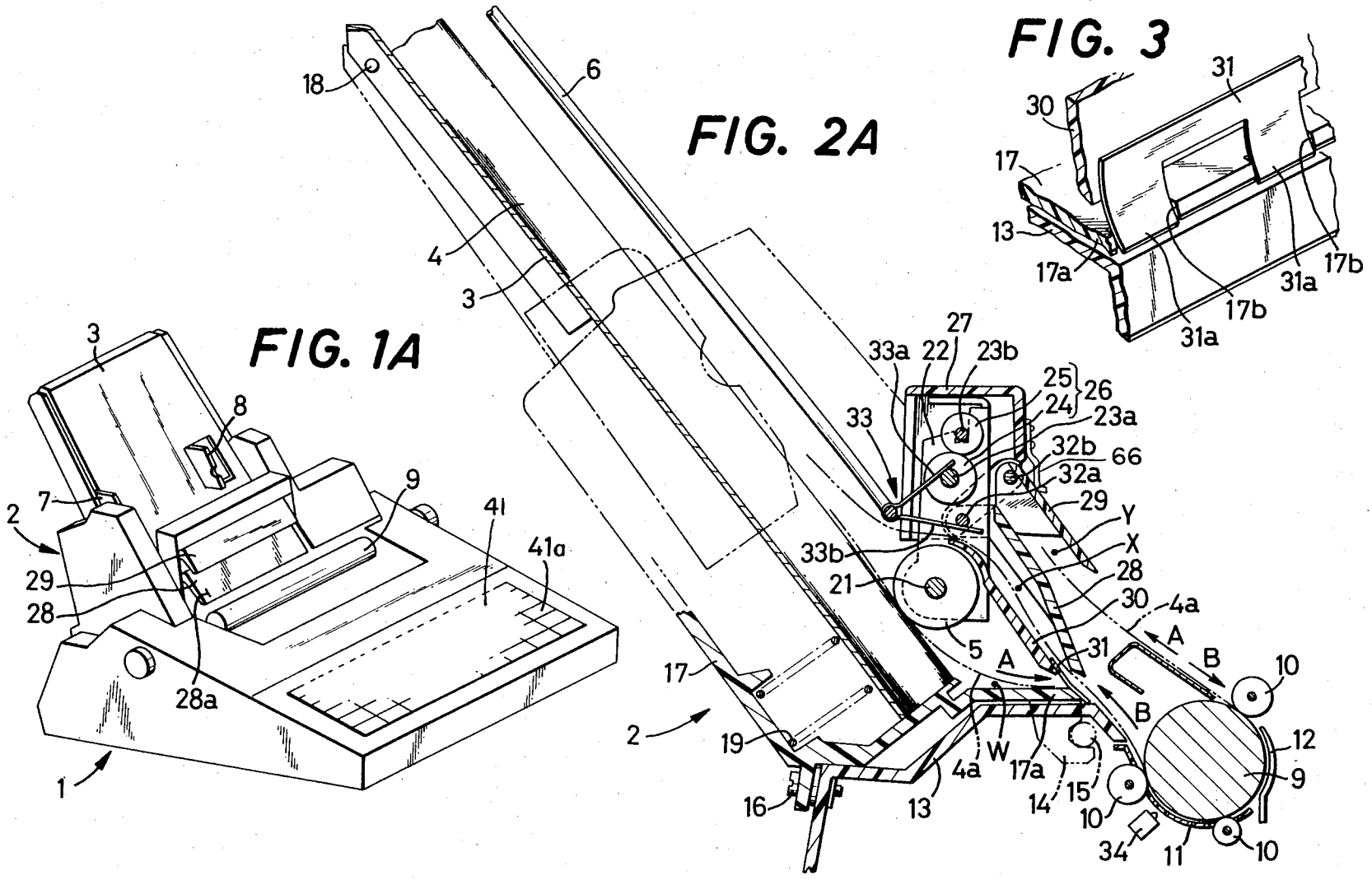
FIG. 1A is a perspective overall view of a typewriter equipped with a paper loading apparatus in one preferred embodiment of the present invention.
FIG. 2A is a fragmentary side elevational view in cross section of the typewriter of FIG. 1, showing the paper loading apparatus.
FIG. 3 is a fragmentary perspective view showing in enlargement guide means for guiding a sheet of paper according to the invention.
Figure 1B:
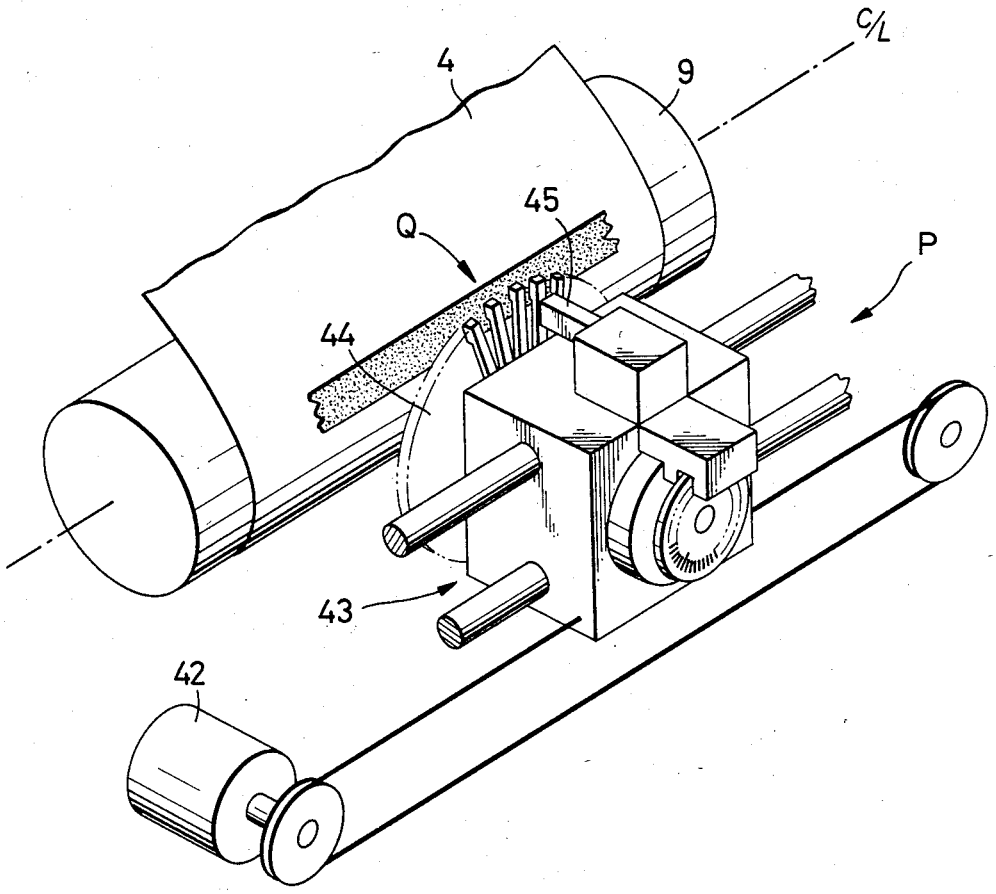
FIG. 1B is a perspective view of a printing device of the typewriter of FIG. 1.

Referring first to FIGS. 1A, 1B, 2A, 2B and 3–5, there is shown a typewriter generally indicated at 1. The typewriter 1 is equipped with a paper loading apparatus generally indicated at 2 in FIGS. 1A and 2A, and a printing device P as shown in FIG. 1B. The printing device P includes a carriage drive motor 42, a carriage 43 movable by the drive motor 42, and a printing assembly Q which carries a print wheel 44 and a print hammer 45. The paper loading apparatus 2 includes a first paper storage tray or stacker 3 for storing sheets of paper 4 in a stack, and feed rollers 5 which are engageable with the top of the paper stack and rotated for feeding the individual sheets of paper 4 one after another along a first paper path W toward a later described paper feeding device of the typewriter 1. The paper loading apparatus 2 further includes a second paper stacker 6 which receives the printed sheets 4 of paper ejected after they have been printed by the printing assembly Q More specifically, printing is effected on the loaded sheet of paper 4 along a line of printing, by the print wheel 44 while the carriage 43 is moved along the printing line. As shown in FIG. 1A, the first paper stacker 3 has a fixed paper locator 7 which is used to position the stacked sheets 4 at their left-side edge, and a movable paper guide 8 which is movable across the width of the paper 4 according to a specific size of the paper 4 stacked on the paper stacker 3.

Figure 2B:
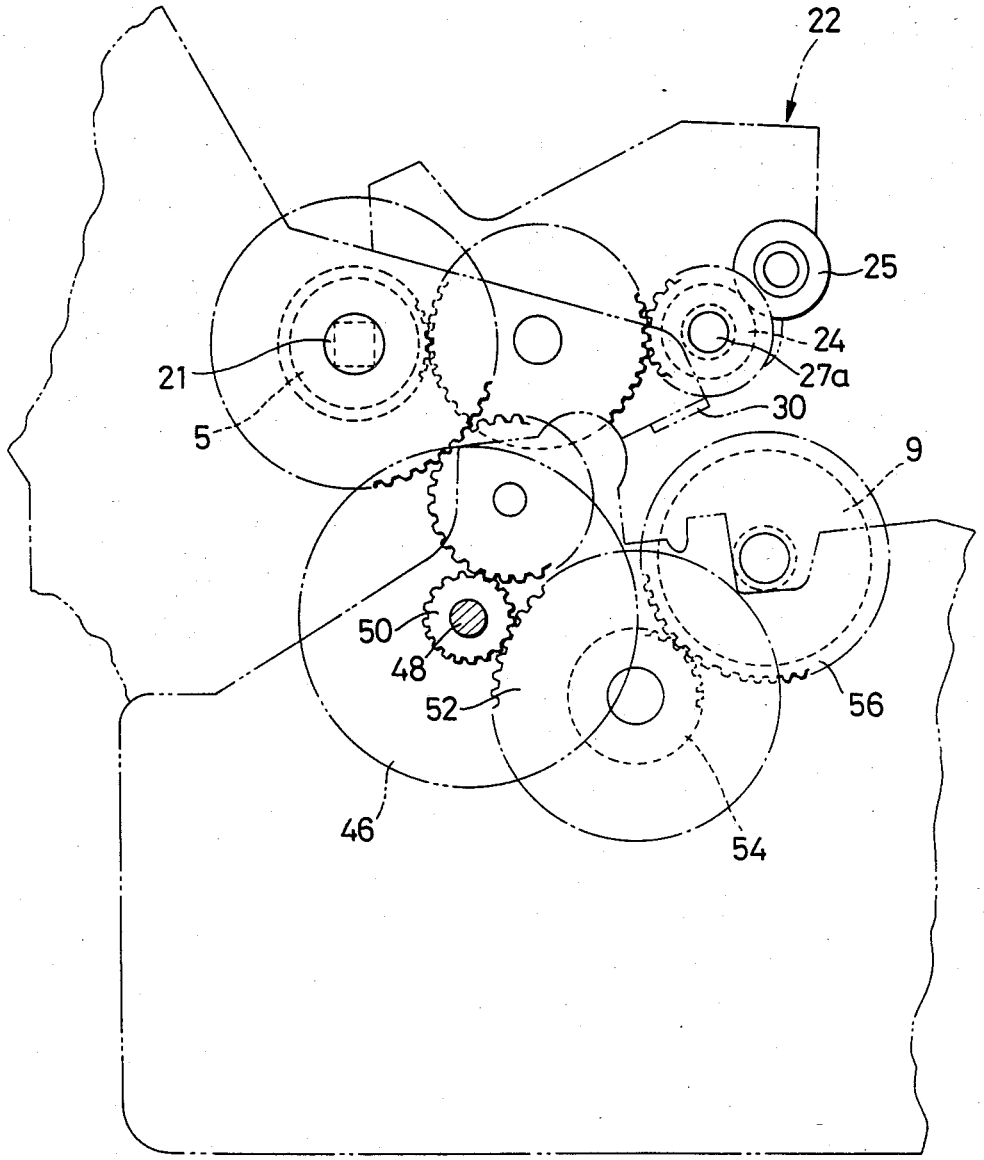
FIG. 2B is a schematic view in cross section of power transmission lines of the paper loading apparatus of FIG. 2A.

The paper feeding device of the typewriter 1, as depicted in detail in FIGS. 2A and 2B, comprises a paper moving platen 9 rotated by a drive motor 46 about an axis C/L parallel to the line of printing, and three presser guide rollers 10 which are spaced from each other circumferentially of the platen 9 such that they are held in pressed contact with the circumferential surface of the platen 9. As shown in FIG. 2B, the drive motor 46 has an output shaft 48 coupled to the platen 9 via a gearing transmission which comprises a gear 50 fixed to the output shaft 48, an intermediate gear 52 engaging the gear 50, another intermediate gear 54 coaxially attached to gear 52, and a platen gear 56 which is fixed to the platen 9 and engages the gear 54. Adjacent the two guide rollers 10 located below the platen 9, there is disposed a paper guide pan 11 which cooperates with a card-holder 12 in front of the platen 9 to guide the paper sheet 4 around the circumference of the platen 9 while the sheet 4 is moved through the nip of the guide rollers 10 and the rotating platen 9.

The paper loading apparatus 2 mounted on a typewriter cover 13 has hooks 14 which are provided at its front lower portion to engage with pins 15 provided on a frame of the typewriter 1. With the hooks 14 in engagement with the pins 15, the apparatus 2 is secured to the typewriter cover 13 by screws 16 which are tightened at a rear lower portion of a frame 17 of the apparatus 2. In the frame 17, the first paper stacker 3 is supported pivotally about a support shaft 18 at its upper portion, and biased at its lower portion by a compression coil spring 19 disposed between the stacker 3 and the frame 17 so that the stack of sheets 4 is held in pressed contact with the circumference of the feed rollers 5 for feeding the top sheet 4 toward the paper feeding device along the first paper path W. This paper path W is partly defined by a portion 17*a* of the frame 17 which serves as a first paper guide 17*a*.

The feed rollers 5 are fixed to a feed drive shaft 21 which is rotatably supported in the frame 17 and driven by the previously indicated drive motor 46 in synchronization with the platen 9. This feed drive shaft 21 supports a support frame 22 pivotally thereabout between its first position of FIG. 4 and its second position of FIG. 5. The support frame 22 supports a rod 23*a* which is rotated synchronously with the platen 9 and to which driving rollers 24 are fixed. The driving rollers 24 are held in pressed contact with driven rollers 25 which are rotatably supported by a rod 23*b* also supported by the support frame 22. These driving and driven rollers 24 and 25 constitute a set of paper ejection rollers 26 which receive the printed sheet of paper 4 and eject it toward the second paper stacker 6. The ejection rollers 26 are covered by a sub-frame 27 secured to the support frame 22. A second paper guide 28 and a third paper guide 29 are conected to the sub-frame 27 such that these guides 28, 29 are pivotable about their connected ends relative to each other and to the sub-frame 27 when the support frame 22 is pivoted between the first and second positions, as described later in detail referring to FIGS. 4 and 5.

Behind the second paper guide 28 is disposed a guide wall 30 formed on the frame 17. The guide wall 30 is substantially parallel to the second paper guide 28 in its normal position of FIGS. 2A and 4. The upper end of the guide wall 30 is located adjacent the circumference of the feed rollers 5. The guide wall 30 is provided at its lower end with a trap member 31 made of a relatively thin film. This trap member 31 extends toward a guiding surface of the first paper guide 17*a* with its lower end located in the vicinity of the guiding surface. The trap member 31 is oriented so that its one surface forms an acute angle with respect to the guiding surface of the first paper guide 17*a* on one side of its lower end on the side of the feed rollers 5, and so that the opposite surface forms an obtuse angle with respect to said guiding surface on the other side of its end on the side of the platen 9. As illustrated in enlargement in FIG. 3, the trap member 31 is a generally comb-shaped member having a plurality of teeth 31*a* which extend toward the guiding surface of the first paper guide 17*a* such that the lower ends thereof are located close to the upper surface of the typewriter cover 13. The teeth 31*a* are accommodated in corresponding recesses 17*b* formed at the end of the first paper guide 17*a*. The depth of each recess 17*b* is greater than the thickness of each tooth 31*a* so that the outer surface of the tooth 31*a* is located below the adjacent surface of the first paper guide 17*a*. Since the trap member 31 is easily flexible, it permits the sheet of paper 4 to be fed along the first paper path W in a direction A (FIG. 2A) with its leading end pushing the trap member 31 and passing between the lower end of the trap member 31 and the guiding surface of the first paper guide 17*a*.

As indicated in FIG. 2A, the second paper stacker 6 comprises a frame structure including a first member made of wire material on which the printed sheets of paper 4 are placed in stack, and second members made of resilient material generally indicated at 33. Each of these resilient second members 33 consists of a first arm portion 33*a* which is urged onto the rod 23*a* and serves to support a bottom edge of the paper stack, and a generally comb-shaped second arm portion 33*b* which is urged onto a pivot pin 32*a* by which the second paper guide 28 is pivotally supported. The second arm portion 33*b* cooperates with the second paper guide 28, guide wall 30 and trap member 31 to define a second paper path X which is separated from the first paper path W by the guide wall 30 and the trap member 31. Further, when the support frame 22 (sub-frame 27) is placed in its first position of FIGS. 2 and 4, a third paper path Y is defined by the second paper guide 28 in cooperation with the third paper guide 29 which is pivotable about a pivot pin 32*b* which, like the pivot pin 32*a*, is secured to the sub-frame 27.

Below the paper guide pan 11 and between the lower two guide rollers 10, there is disposed a photo-electric paper sensor 34 so as to face the lower circumferential surface of the platen 9. This paper sensor 34 detects a sheet of paper 4 being fed from the first paper stacker 3 along the first paper path W.

Figure 8:
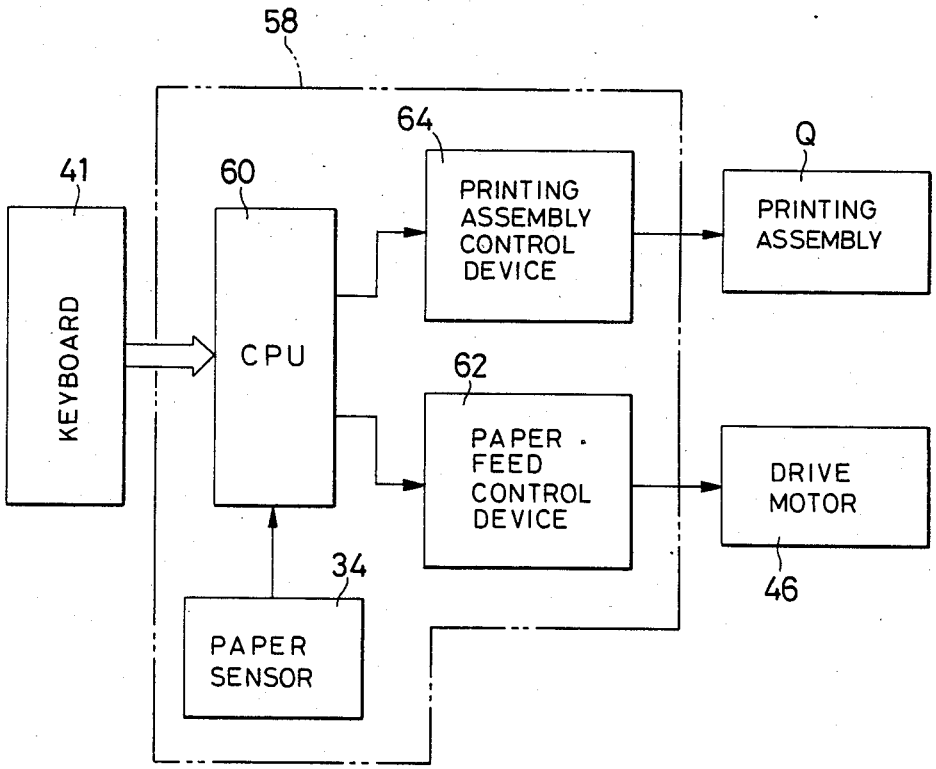
FIG. 8 is a schematic block diagram showing a control system of the typewriter.

The typewriter 1 has a control system (control means) 58 as shown in FIG. 8, which includes: a central processing unit (CPU) 60; a paper feed control device 62 for controlling the operation of the drive motor 46; and a printing assembly control device 64 for controlling the operation of the printing assembly Q.

In the paper loading apparatus 2 constructed as heretofore described, actuating a PAPER INSERT key 41*a* on a keyboard 41 of the typewriter 1 will trigger the drive motor 46 to rotate the feed rollers 5, platen 9 and drive ejection rollers 24 in the counterclockwise direction (in FIG. 2B), whereby the top sheet 4*a* of the paper stack is fed in the forward direction A along the first paper path W with the leading edge pushing out the flexible teeth 31*a* and thereby clearing the trap member 31. Thus, the paper sheet 4*a* is fed toward the paper feeding device. When the leading edge has passed the nip between the platen 9 and the first set of guide rollers 10 and has been detected by the paper sensor 34 between the first and second sets of guide rollers 10, the power transmission between the drive motor 46 and the feed drive shaft 21 (feed rollers 5) is disconnected. Subsequently, the paper sheet 4*a* is moved forward through rotation of the platen 9 to a predetermined printing start position. During a normal printing operation, the paper sheet 4*a* advanced by the platen 9 is directed along the third paper path Y between the second and third paper guides 28, 29 and ejected through rotation of the ejection rollers 26 into the second paper stacker 6.

However, prior to the final positioning of the paper sheet 4*a* at the predetermined printing start position, the sheet 4*a* is moved backward in a direction B. More specifically stated, as soon as the trailing edge of the paper sheet 4*a* has been detected by the paper sensor 34, the paper feed drive motor 46 is reversed to move the sheet 4*a* backward. In this instance, the trailing edge of the paper 4 is blocked by the teeth 31*a* of the trap member 31 and therefore prevented from returning along the first paper path W toward the feed rollers 5. As a result, the trailing edge is guided by the teeth 31*a* and the guide wall 30 along the second paper path X in which the sheet 4*a* is free from engagement with the feed rollers 5. When the leading edge of the paper sheet 4*a* has been detected during its backward movement in the direction B by the platen 9, the drive motor 46 is again operated in the forward direction and kept operated by a predetermined amount, that is, until the leading edge has reached the predetermined printing start position. Thus, the central processing unit 60 serves as first means responsive to the paper sensor 34 for changing a paper feeding direction from the direction A to the direction B when the paper sensor 34 has detected the trailing edge of the sheet 4*a* during its forward movement, and also serves as second means responsive to the paper sensor 34 for changing the feeding direction from the direction B to the direction A when the leading edge of the sheet 4*a* has been detected by the paper sensor 34 during the backward movement.

With the above arrangement, the paper sheet 4*a* is protected from bending, warpage or crease due to an otherwise possible engagement of the trailing edge with the feed rollers 5 when the sheet 4*a* is moved backward during a printing operation.

It is noted that the above discussed movement of paper into the second paper path X prior to its final positioning may be effected for all sheets of paper 4 or for only the selected sheets 4 which require backward movements during printing thereon.

Although the paper sensor 34 is used in the above embodiment to control the paper feeding device for the forward and backward movements of the paper sheet 4*a*, it is possible to utilize such control means that permits the feed drive motor 46 to be controlled in its operating amount and direction according to a stored program prepared to suit a particular size of paper used. In this case, the control means causes the paper feeding device to be operated by a first predetermined amount in the forward direction corresponding to the feeding direction A, and subsequently operated by a second predetermined amount in the backward direction corresponding to the feeding direction B.

Figures 4, 5, 6, 7:
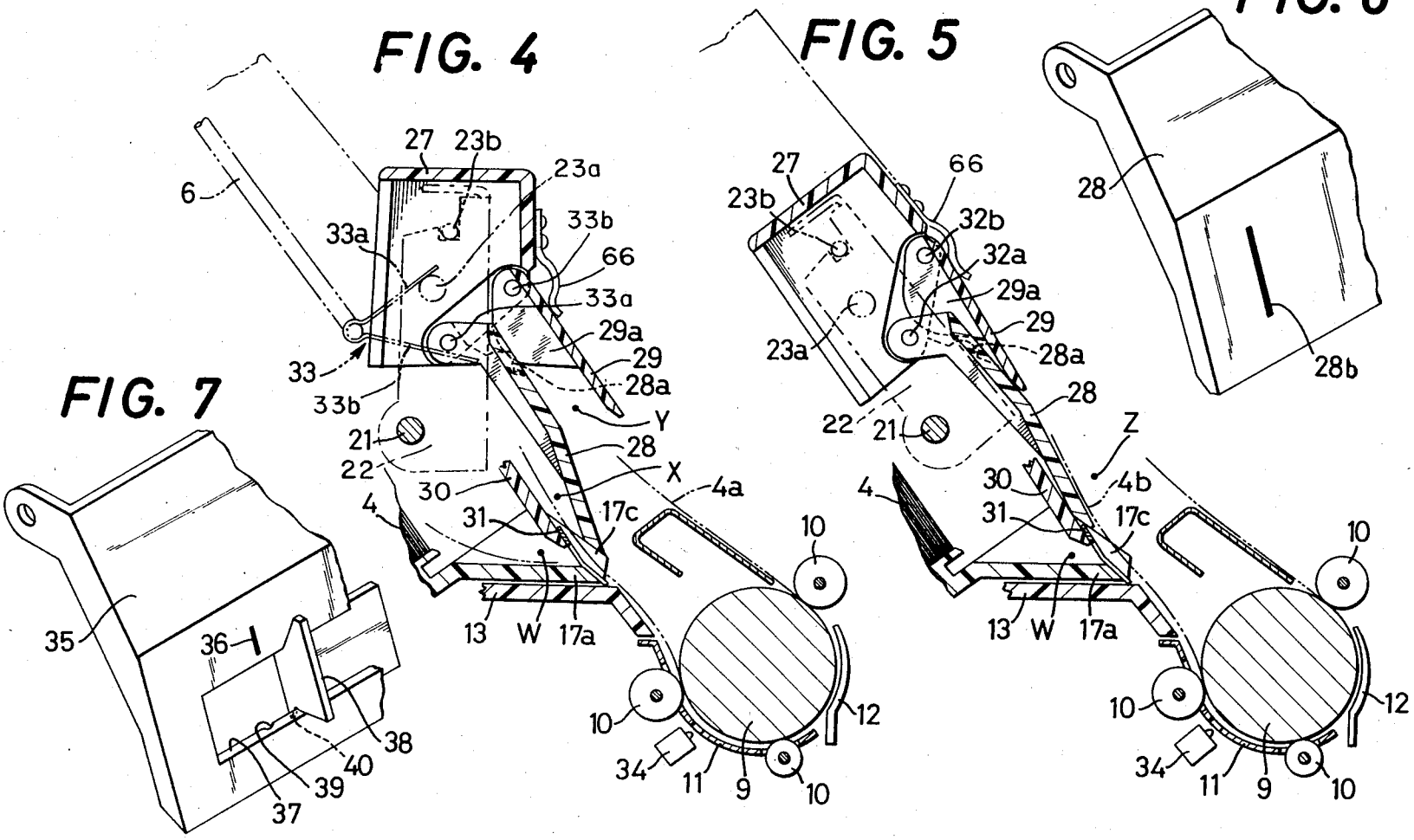
FIGS. 4 and 5 are views similar to FIG. 2 but in different cross section, showing two different positions of a pivotable paper guiding assembly including paper guides and a support frame.
FIG. 6 is a fragmentary perspective view of one of the paper guides having an indicator for positioning a manually fed sheet of paper at its side edge.
FIG. 7 is a fragmentary perspective view of a paper guide alternative to that of FIG. 6 which also has a paper locator for positioning the manually fed paper sheet.

Referring to FIGS. 4 and 5, there will be described in detail the pivotal movements of the support frame 22 or sub-frame 27 and the second and third paper guides 28 and 29. The second paper guide 28 has a protuberance 28*a* adjacent its pivotal fulcrum, i.e., pivot pin 32*a*. The third paper guide 29 has a cam block 29*a* adapted to be engageable with the protuberance 28*a*, and is biased by a spring 66 in the direction that causes it to pivot clockwise (in FIGS. 4 and 5), whereby the cam block 29*a* is kept in contact with the protuberance 28*a*. In this condition, the lower portion of the second paper guide 28 is held in abutment on front surfaces of side guides 17*c* which are portions of the frame 17.

With the support frame 22 placed in the first position of FIG. 4, the second and third paper guides 28 and 29 form the third paper path Y through which the printed sheet 4*a* is directed to the ejection rollers 26, as discussed above. When it is desired to interrupt printing operations on the sheets of paper 4*a* from the first paper stacker 3 and load a sheet of paper 4*b* different in size from the sheet 4*a*, the sub-frame 27 is pivoted from its first position of FIG. 4 to its second position of FIG. 5. As the sub-frame 27 is pivoted, the lower end of the second paper guide 28 is moved in contact with the surface of the side guides 17*c* while, at the same time, the cam block 29*a* of the third paper guide 29 disengages from the protuberance 28*a* of the second paper guide 28, and the third paper guide 29 is pivoted clockwise as seen in FIGS. 4 and 5. As a result, the lower end of the third paper guide 29 is put into abutment on the outer surface of the second paper guide 28 at its intermediate portion, and thus the third paper path Y is closed as shown in FIG. 5. In this condition, the sub-frame 27 is retracted in the frame 17 and held in its inoperative second position. The external portion of the sub-frame 27, and the second and third paper guides 28, 29 cooperate to form a substantially flat continuous guide surface which defines a fourth paper path Z along which the sheet of paper 4*b* can be inserted toward the paper feeding device (platen 9).

As shown in FIG. 6, the second paper guide 28 has on its external surface an indicator 28*b* which shows the position of a left side edge of the sheet 4*a* corresponding to the position of the paper locator 7 provided on the first paper stacker 3. Therefore, when the sub-frame 27 is set in its normal position, the sheet 4*a* positioned by the locator 7 in the first paper stacker 3 is ejected with its left side edge in alignment with the indicator 28*b* after the sheet 4*a* has been printed by the printing device. When the sub-frame 27 is set in its second position, the different sheet 4*b* can be positioned with its left side edge aligned with the indicator 28*b* before it is inserted into the printing device along the fourth paper path Z. Thus, this indicator 28*b* facilitates and assures a printing on the sheet 4*b* with the same tab and margin settings as established for the sheets of paper 4*a* in the stacker 3.

A modified arrangement alternative to the second paper guide 28 is shown in FIG. 7 wherein a second paper guide 35 is provided with an indicator 36 similar to the indicator 28*b*, and further provided with a slot 37 which accommodates a movable paper locator 38. A notch 39 is formed in an inner wall surface defining the slot 37, at a position corresponding to the indicator 36. The paper locator 38 which is slidably movable in the slot 37 along the width of the sheet 4, has a protrusion 40 which is engageable with the notch 39 when the locator 38 is positioned in alignment with the indicator 36. The indicator 36 alone, or the indicator 36 and the locator 38 in combination is/are useful for positioning the different sheet of paper 4*b* before it is loaded.

As discussed hereinbefore, the instant paper loading apparatus 2 is capable of accepting a manually inserted sheet of paper 4*b* which is different in size from sheets of paper 4 stored in the paper stacker 3, by simply pivoting the sub-frame 27 to its second position during a printing operation on the sheets 4 from the stacker 3. Further, the different sheet 46 may be easily positioned in alingment with the indicator 28*b* or 36, and/or paper locator 38 which assure(s) the same tab and margin settings as established by the typewriter 1 for the sheets of paper 4 in the paper stacker 3.

What is claimed is:

1. A paper loading apparatus for a printer wherein sheets of paper are moved by a paper feeding device to a printing device for impression of characters on the paper along a line of printing, which comprises:

a paper stacker for storing a stack of said sheets of paper of one kind;

a feed roller engageable with the top of said stack and rotatable for feeding along a first paper path the individual sheets of paper one after another in one direction from said paper stacker toward said paper feeding device;

a first paper guide defining a part of said first paper path and having a plurality of recesses, control means for controlling said paper feeding device such that the sheets of paper fed from said paper stacker by said feed roller are first moved in said one direction into said printing device and subsequently moved in a reverse direction opposite to said one direction; and guide means for guiding said sheets of paper moving in said reverse direction along a second paper path in which said sheets of paper are free from engagement with said feed roller, said guide means including trap means comprising a generally comb-shaped member having a plurality of teeth which extend toward a guiding surface of said first paper guide with the ends of said teeth located in the vicinity of said guiding surface, said plurality of teeth being accommodated in said plurality of recesses, a depth of said recesses as viewed substantially across said second paper path being greater than a thickness of said teeth, said generally comb-shaped member having a first surface which forms an acute angle with respect to said guiding surface on the side of said paper stacker, and a second surface which forms an obtuse angle with respect to said guiding surface of the side of said printing device, said generally comb-shaped member permitting said sheets of paper to pass between said ends of the teeth and said guiding surface in said one direction along said first paper path, but preventing a trailing end of said sheets of paper past said ends from returning along said first paper path in said reverse direction and thereby guiding said trailing end along said second paper path when said sheets of paper are moved in said reversed direction by said paper feeding device.

2. A paper loading apparatus for a printer wherein sheets of paper are moved by a paper feeding device to a printing device for impression of characters on the paper along a line of printing, which comprises:

a first paper stacker for storing a stack of said sheets of paper of one kind;

a feed roller engageable with the top of said stack and rotatable for feeding along a first paper path the individual sheets of paper one after another in one direction from said first paper stacker toward said paper feeding device;

first guide means for defining said first paper path;

a second paper stacker for receiving the sheets of paper of said one kind after they are printed by said printing device;

a support frame pivotable between a first and a second position; and second guide means for defining a second paper path along which the printed sheets of paper of said one kind are guided toward said second paper stacker, said second guide means comprising a first and a second paper guide each pivotally supported by said support frame, said second paper path being formed between said first and second paper guides when said support frame is placed in said first position, said first and second paper guides being pivotable relative to each other and to said support frame so as to close said second paper path when said support frame is pivoted from said first position to said second position, said first and second paper guides cooperating to form a continuous paper guide surface defining a third paper path leading to said printing device when said support frame is placed in said second position, whereby sheets of paper of another kind different from said one kind are loaded to said printing device along said third paper path;

said first paper stacker including a paper locator for positioning the sheets of paper of said one kind at one side edge thereof, and said first paper guide has another paper locator for positioning the sheets of paper of said another kind which are loaded along said third paper path.

3. A paper loading apparatus for a printer wherein sheets of paper are moved by a paper feeding device to a printing device for impression of characters on the paper along a line of printing, which comprises:

a first paper stacker for storing a stack of said sheets of paper of one kind;

a feed roller engageable with the top of said stack and rotatable for feeding along a first paper path the individual sheets of paper one after another in one direction from said first paper stacker toward said paper feeding device;

control means for controlling said paper feeding device such that the sheets of paper fed from said first paper stacker by said feed roller are first moved in said one direction into said printing device and subsequently moved in a reverse direction opposite to said one direction;

a first paper guide for guiding said sheets of paper moving in said reverse direction along a second paper path in which said sheets of paper are free from engagement with said feed roller;

a second paper stacker for receiving the sheets of paper of said one kind after said sheets of paper of said one kind are printed by said printing device;

a second paper guide cooperating with said guide means to define a part of said second paper path;

a third paper guide cooperating with said second paper guide to define a third paper path leading to said second paper stacker; and a support frame pivotable between a first and a second position and pivotally supporting said second and third paper guides, said third paper path being formed between said second and third paper guides when said support frame is placed in said first position, said second and third paper guides being pivotable relative to each other and to said support frame so as to close said third paper path when said support frame is pivoted from said first position to said second position, said second and third paper guides cooperating to form a continuous paper guide surface defining a fourth paper path leading to said printing device when said support frame is placed in said second position, whereby sheets of paper of another kind different from said one kind are loaded to said printing device along said fourth paper path.

4. A paper loading apparatus as recited in claim 3, wherein said first paper stacker includes a paper locator for positioning the sheets of paper of said one kind at one side edge thereof, and said second paper guide has indicator means for showing a side edge position of the sheets of paper of said another kind corresponding to said one side edge of the sheets of paper of said one kind when the sheets of paper of said another kind are loaded along said fourth paper path.

5. A paper feeding apparatus as recited in claim 3, wherein said first paper stacker includes a paper locator for positioning the sheets of paper of said one kind at one side edge thereof, and said second paper guide has another paper locator for positioning the sheets of paper of said one kind which are loaded along said fourth paper path.

* * * * *